US011605291B2

(12) United States Patent
Lamoncha

(10) Patent No.: US 11,605,291 B2
(45) **Date of Patent: *Mar. 14, 2023**

(54) STOP SIGN WITH TRAFFIC CONTROL FEATURES

(71) Applicant: Mark Lamoncha, Columbiana, OH (US)

(72) Inventor: Mark Lamoncha, Columbiana, OH (US)

( * ) Notice: Subject to any disclaimer, the term of this patent is extended or adjusted under 35 U.S.C. 154(b) by 76 days.

This patent is subject to a terminal disclaimer.

(21) Appl. No.: 17/201,266

(22) Filed: Mar. 15, 2021

(65) Prior Publication Data

US 2021/0201663 A1 Jul. 1, 2021

Related U.S. Application Data

(63) Continuation-in-part of application No. 17/158,365, filed on Jan. 26, 2021, which is a continuation of (Continued)

(51) Int. Cl.

| | |
|---|---|
| ***G08G 1/01*** | (2006.01) |
| ***G08G 1/04*** | (2006.01) |
| ***G08G 1/085*** | (2006.01) |

(52) U.S. Cl.

CPC ..... *G08G 1/0116* (2013.01); *G08G 1/04* (2013.01); *G08G 1/085* (2013.01)

(58) Field of Classification Search

None

See application file for complete search history.

(56) References Cited

U.S. PATENT DOCUMENTS 5,673,039 A * 9/1997 Pietzsch ..... G08G 1/015 340/905
6,243,644 B1 * 6/2001 Dengler ..... G08G 1/01 340/933

(Continued)

FOREIGN PATENT DOCUMENTS

CA 3047398 A1 * 6/2018 ..... G08G 1/0104
FR 3022673 A1 12/2015
FR 3040104 A1 2/2017

OTHER PUBLICATIONS

Evelots Flashing LED Auto Parking Signal, Amazon.com, site visited Aug. 21, 2018.

(Continued)

*Primary Examiner* — Fekadeselassie Girma

(74) *Attorney, Agent, or Firm* — Standley Law Group LLP; Jeffrey S. Standley; Adam J. Smith

(57) ABSTRACT

Systems and methods for providing traffic signals to drivers of vehicles include vehicle-based systems which visually or audibly provide wait and proceed messages to drivers. A command center electronically receives arrival times recorded by time keeping devices of stop signs at an intersection upon arrival of the vehicles as determined by vehicle detection devices. Identifiers for the arriving vehicles are received and associated with the arrival times. A command is transmitted to set the traffic signaling device of the stop sign associated with an earliest arrival time to proceed, and if the earliest arrival time is associated with an identifier, to provide the proceed message at the vehicle-based systems associated the identifier.

21 Claims, 11 Drawing Sheets

Related U.S. Application Data application No. 16/682,723, filed on Nov. 13, 2019, now Pat. No. 10,937,309.

(60) Provisional application No. 62/769,034, filed on Nov. 19, 2018.

(56) References Cited

U.S. PATENT DOCUMENTS 6,580,374 B2 * 6/2003 Schrage ..... G08G 1/095 340/905
6,693,556 B1 * 2/2004 Jones ..... G08G 1/095 340/815.45
7,075,427 B1 * 7/2006 Pace ..... B61L 23/06 246/126
7,696,903 B2 * 4/2010 Stam ..... G08G 1/052 340/936
8,442,750 B1 * 5/2013 Tran ..... G08G 1/04 340/905
8,793,062 B2 * 7/2014 Fino ..... G01C 21/3492 701/1
9,550,498 B2 * 1/2017 Meyer ..... G06V 20/56
10,055,986 B2 * 8/2018 Paruch ..... G08G 1/081
10,176,712 B1 * 1/2019 Martins ..... G08G 1/07
10,403,142 B1 * 9/2019 Shuff ..... G08G 1/095
10,650,672 B2 * 5/2020 Shuff ..... G08G 1/005
10,937,309 B2 * 3/2021 Lamoncha ..... G08G 1/04
2004/0183694 A1 * 9/2004 Bauer ..... G08G 1/095 340/933
2010/0283631 A1 * 11/2010 Bryant ..... G08G 1/07 340/916
2013/0100286 A1 * 4/2013 Lao ..... G06V 20/54 348/148
2016/0005313 A1 * 1/2016 Cholayil ..... G08G 1/04 340/907
2017/0046954 A1 * 2/2017 Leversen ..... E01F 9/00
2017/0103650 A1 * 4/2017 Amadon ..... G08G 1/095
2018/0103240 A1 * 4/2018 Barnes ..... G01P 13/00
2019/0035263 A1 1/2019 Loes
2019/0206254 A1 * 7/2019 Tao ..... B60W 50/14
2019/0279508 A1 * 9/2019 Wang ..... H04W 4/46
2020/0096977 A1 * 3/2020 Itou ..... G08G 1/081
2020/0160693 A1 * 5/2020 Lamoncha ..... G08G 1/095
2021/0150891 A1 * 5/2021 Lamoncha ..... G08G 1/04
2021/0201663 A1 * 7/2021 Lamoncha ..... G08G 1/095
2021/0264774 A1 * 8/2021 Lamoncha ..... G08G 1/085

OTHER PUBLICATIONS

Perfectstop Sign—Intelligent Stop Sign System, www.indiegogo.com, site visited Aug. 21, 2018.
Safe-T-Signal Warning System, www.ritehite.com, site visited Aug. 21, 2018.

* cited by examiner

STOP SIGN WITH TRAFFIC CONTROL FEATURES

CROSS-REFERENCE TO RELATED APPLICATION

This application is a continuation-in-part of U.S. application Ser. No. 17/158,365 filed Jan. 26, 2021, which is a continuation of U.S. application Ser. No. 16/682,723 filed Nov. 13, 2019, which claims the benefit of U.S. Provisional Application No. 62/769,034 filed Nov. 19, 2018, the disclosures of each of which are hereby incorporated by reference as if fully restated herein.

TECHNICAL FIELD

Exemplary embodiments of the present invention relate generally to systems and methods for controlling traffic using a stop sign with traffic control features.

BACKGROUND AND SUMMARY OF THE INVENTION

Traffic congestion is frequently caused by roadway intersections. Traffic often becomes backed up at intersections where conventional stop signs are used to control traffic because drivers are unsure of which driver has the right of way to cross the intersection first. Furthermore, traffic collisions often occur when one driver proceeds despite not having the right of way. While traffic lights can provide for improved traffic flow and reduced accidents, they are too expensive to install at every intersection. Furthermore, stop signs are not adaptable to changing traffic conditions.

Therefore, what is needed is stop sign with traffic control features. The present invention is a stop sign with traffic control features.

An assembly may comprise a conventional stop sign, which may be mounted to a post, pole, or the like. A traffic control unit may comprise one or more signaling devices which direct the driver of a nearby vehicle to proceed or wait. A vehicle detection device may detect vehicles located at or near the assembly. A controller may receive information from the vehicle detection device and direct the traffic control unit. The controller may receive instructions from a central command unit. The central command unit may be in communication with several or all assemblies for a given intersection. A power supply, such as a solar panel, may be electrically connected with various components of the assembly to provide power to the same.

The assembly may continuously scan for the arrival of a vehicle. Once a vehicle is detected, the assembly may note the arrival time and transmit the arrival time to the command center. The command center may determine if an earlier arrival time within a predetermined amount of time has been logged by the same or a different assembly for an intersection. If not, the command center may direct the respective assembly to set its traffic signaling device to proceed. If not, the system may wait until the predetermined time is reached and then direct the respective assembly to set its traffic signaling device to proceed.

Distracted drivers may not always notice a stop sign or a traffic signal indicated at a traffic signaling device. This may result in running of red lights, running of stop signs, or collisions. Even where there is merely a delay by the distracted driver in noticing a changing traffic signal, traffic delays, confusion for other drivers, and the like may result. In some cases, it may be safer to override or control the vehicle's advancement in turn through the intersection. Therefore, what is needed is the ability to communicate traffic signals and changes to drivers within their vehicles, and/or override driver actions or otherwise autonomously control vehicle movements based on such signals.

Systems and methods are disclosed for communicating traffic signals to a driver of a vehicle using certain systems located within a vehicle. Vehicles equipped with vehicle-based systems may wirelessly communicate with one or more assemblies and/or the command center. The vehicle-based systems may communicate an identifier for the vehicle which may be used to track which vehicle-based system to send proceed and wait signals to. Upon receipt of a proceed signal or a wait signal, the vehicle-based system may alert the driver to the same. If the driver attempts to proceed during a wait signal, the vehicle interface system may cause the vehicle to slow or stop. If the driver fails to proceed during a proceed signal, the vehicle-based system may further alert the driver to the proceed signal. Communication between the vehicle-based system and the assembly and/or the command center may be accomplished by one or more wireless communication devices.

The assemblies may be equipped to accommodate both vehicles having the vehicle-based systems, such as by way of wireless communication devices, and vehicles without the vehicle-based systems, such as by way of proximity sensors, cameras, combinations thereof, or the like.

In exemplary embodiments, without limitation, the upon receipt of a proceed signal, the vehicle-based system may command certain vehicle systems to advance the vehicle through the intersection autonomously by controlling certain vehicle systems. Upon receipt of a wait signal, the vehicle-based system may command certain vehicle systems to halt the vehicle.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
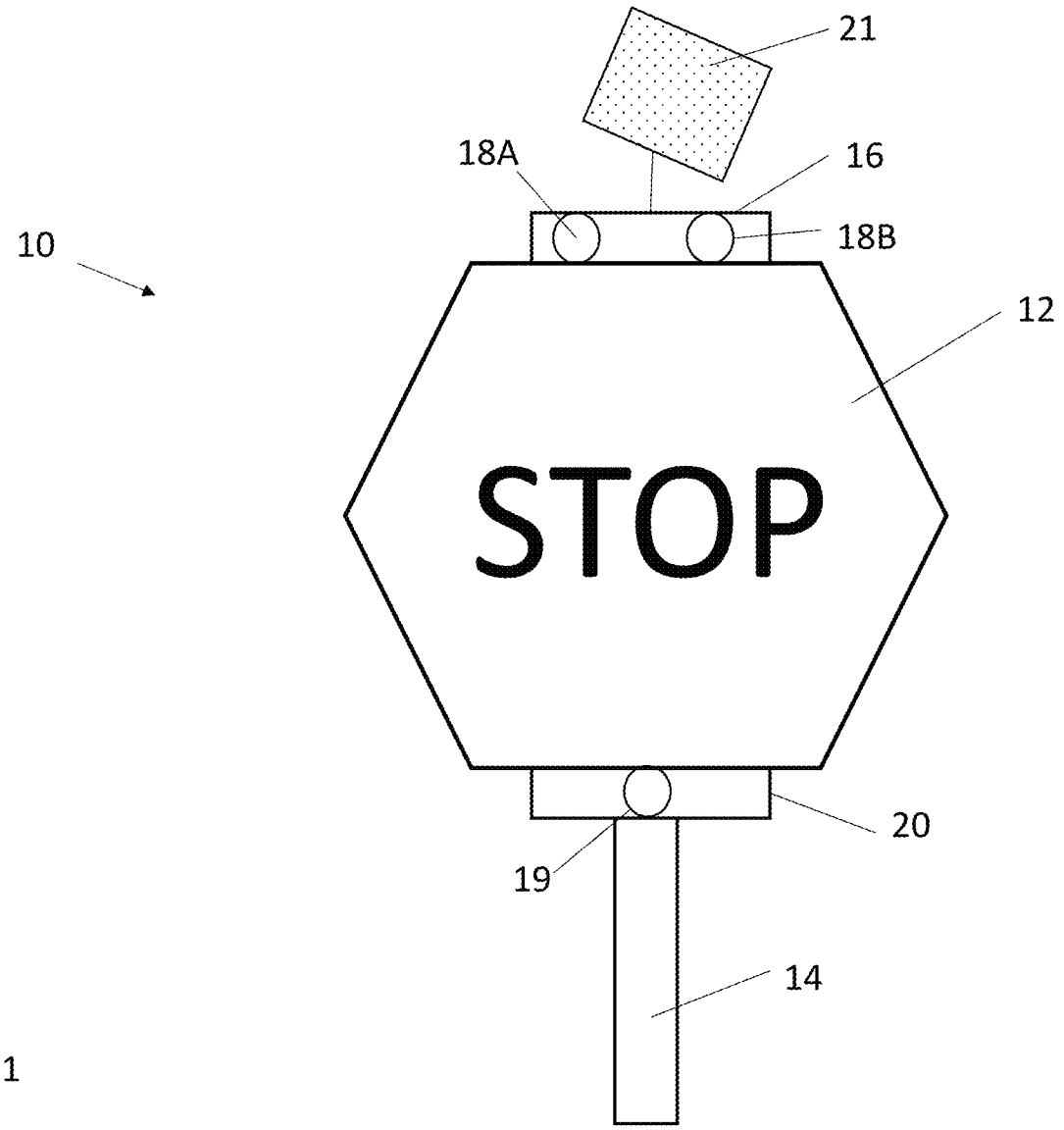
FIG. 1 is front view of an exemplary assembly in accordance with the present invention.

FIG. 1 is front view of an exemplary assembly 10 in accordance with the present invention. The assembly 10 may comprise a conventional stop sign 12. The stop sign 12 may be a static sign, a digital sign, some combination thereof, or the like. The stop sign 12 may be mounted to a mounting device 14. The mounting device 14 may comprise a post, pole, some combination thereof, or the like. The stop sign 12 may be mounted in any fashion, such as but not limited to, an overhead member, a wall, a stand, or the like.

The assembly 10 may comprise a traffic signaling device 16. The traffic signaling device 16 may comprise one or more signaling devices 18A and 18B configured to provide wait and proceed signals. In exemplary embodiments, the signaling devices 18A and 18B comprise one or more colored lights, such as but not limited to red (for wait) and green (for proceed), configured to be selectively illuminated to signal the driver of a vehicle 70 to proceed or to wait. However, any type of signaling devices 18A and 18B is contemplated, such as but not limited to, flags, signs, speakers for producing an audio signal, some combination thereof, or the like. Any number and type of signaling devices 18A and 18B are contemplated. The signaling devices 18A and 18B on various assemblies 10 may be the same or different types. The traffic signaling device 16 may be mounted to the assembly 10, such as above the stop sign 12 though any location is contemplated. In other exemplary embodiments, the traffic signaling device 16 may be located in close proximity with the assembly 10.

The assembly 10 may comprise a vehicle detection device 19. The vehicle detection device 19 may comprise one or more sensors configured to detect the presence of one or more vehicles 70. The vehicle detection devices 19 may comprise, for example without limitation, cameras, radar, lasers, motion detectors, light sensors, audio sensors, ultrasound sensors, infrared sensors, weight sensors, metal detectors, image recognition software, proximity detectors, some combination thereof, or the like. Alternatively, or in addition, the vehicle detection devices 19 may comprise far-range wireless communication devices such as, but not limited to, wi-fi, cellular network connectivity devices, internet connectivity devices, radio transmitters/receivers, network adapters, combinations thereof, or the like, and/or near field communication devices, such as but not limited to, RFID, Bluetooth®, combinations thereof or the like. The vehicle detection devices 19 may be configured to receive signals from devices installed in vehicles 70 within signaling range of such the vehicle detection devices 19. The vehicle detection device 19 may be mounted to the assembly 10. However, in other exemplary embodiments, the vehicle detection device 19 may instead be located in close proximity with the assembly 10.

The assembly 10 may further comprise a controller 20. The controller 20 may be in communication with one or more of the traffic signaling devices 16 and the vehicle detection device 19. The controller 20 may receive data from the vehicle detection device 19 and provide instructions to the traffic signaling device 16. As will be explained in greater detail, in exemplary embodiments the controller 20 is in communication with a command center 32. In such embodiments, the controller 20 may communicate information from the vehicle detection device 19 to the command center 32 and receive instructions from the command center 32, which may be relayed to the traffic signaling device 16.

The controller 20 may further comprise a time keeping device 28. The time keeping device 28 may be a clock, timing device, timer, some combination thereof, or the like. The time keeping device 28 may be in electronic communication with the processor 24. It is contemplated that the vehicle detection device 19 may alternatively or additionally comprise the time keeping device 28. Any location of the time keeping device 28 is contemplated.

The assembly 10 may further comprise a power source 21. The power source 21 may be in electrical connection with one or more of the traffic control unit 16, the vehicle detection device 19, and the controller 20. In exemplary embodiments, the power source 21 may comprise a solar panel. Alternatively, or in addition, the power source 21 may comprise one or more batteries. Alternatively, or in addition, the power source 21 may comprise a connector for connecting to utility power.

Figure 2:
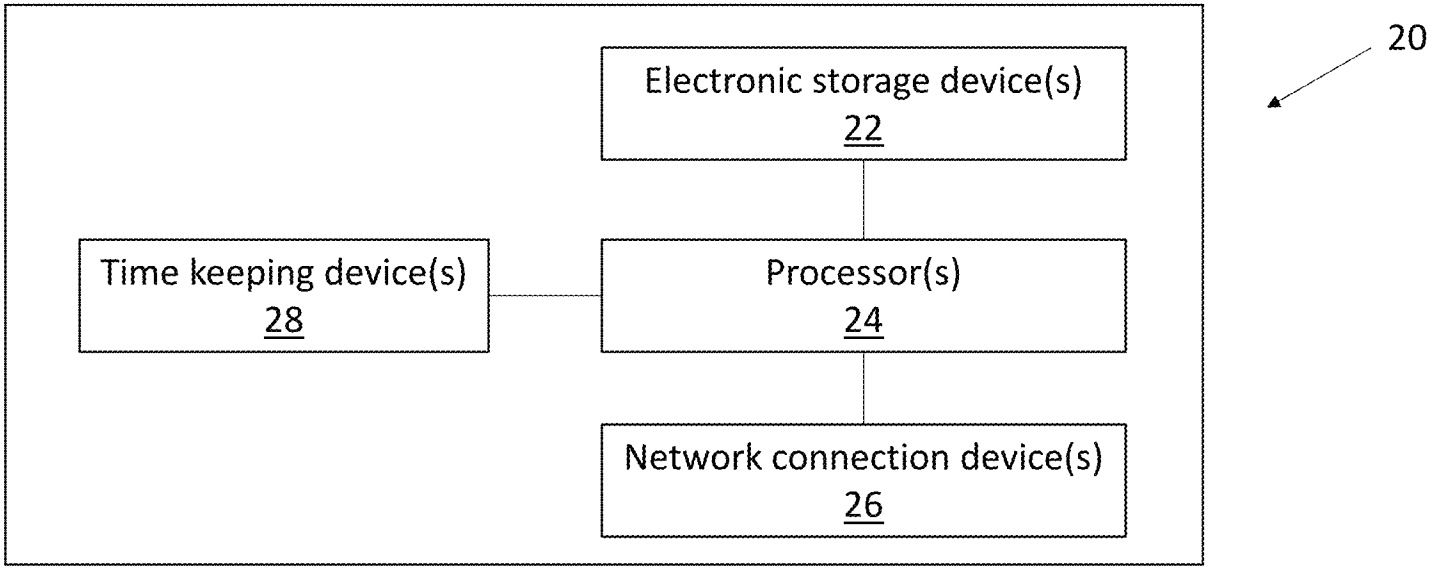
FIG. 2 is a simplified illustration of a controller.

FIG. 2 is a simplified illustration of the controller 20. The controller 20 may be in communication with the vehicle detection device 19 and the traffic signaling device 16. The controller 20, and various components thereof, may be electrically connected to the power supply 21. The controller 20 may comprise one or more electronic storage devices 22, processors 24, and network connection devices 26. The electronic storage device 22 may be configured to receive and store data from the vehicle detection device 19 and/or the controller 20. The electronic storage device 22 may further comprise executable software instructions, which when executed configure the processor 24 to perform one or more of the processes disclosed herein. The processor 24 may be configured to retrieve the data and/or executable software instructions stored at the electronic storage device 22. The network connection device 26 may be configured to transmit and receive data, such as but not limited to data stored at the electronic storage device 22, to the command center 32 and/or to other remote device(s). Such communication may be accomplished by way of a network such as the internet, intranet, cellular network, world wide web, or the like. Such communication may be accomplished by wired or wireless means.

Figure 3:
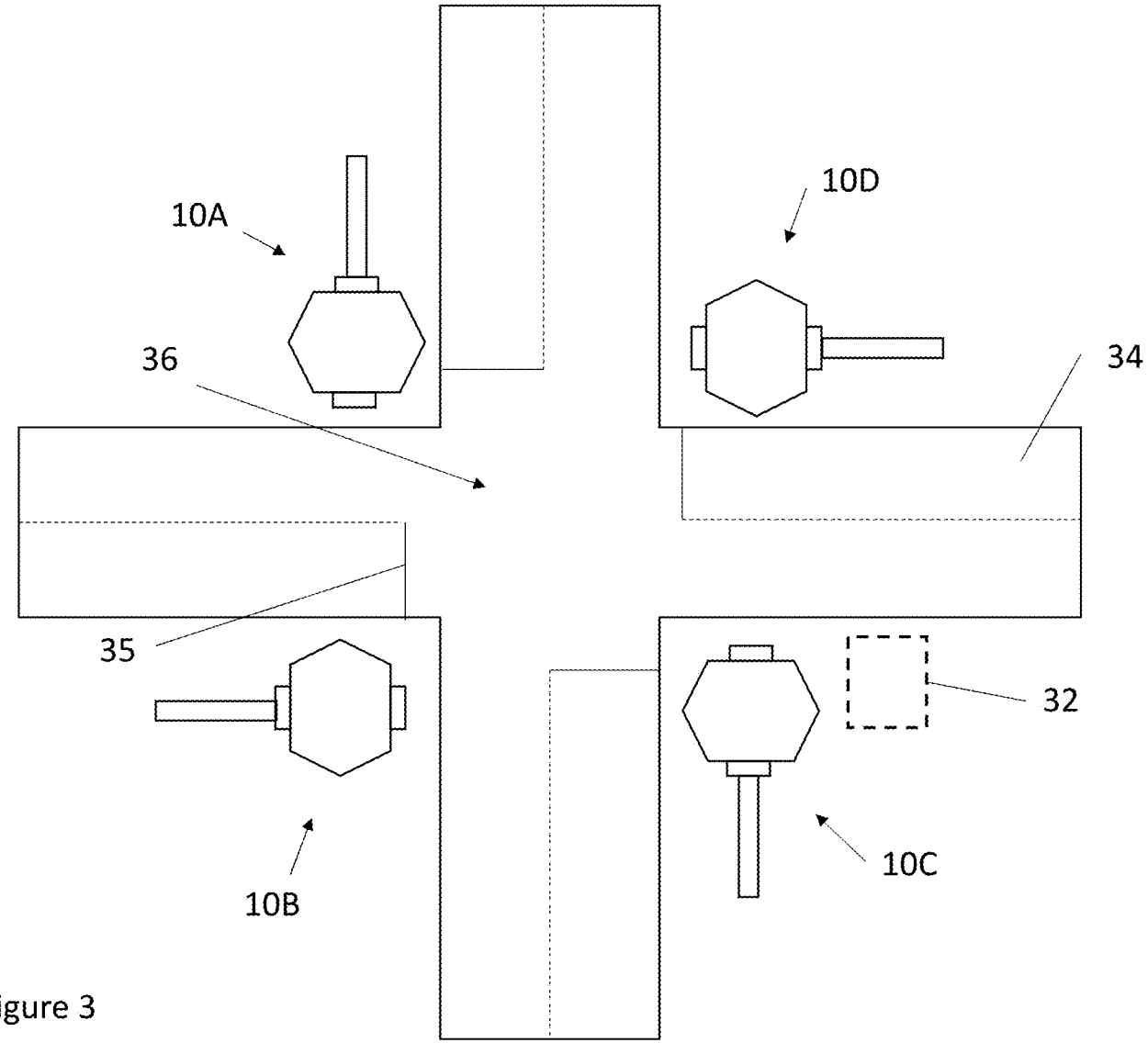
FIG. 3 is a top plan view of an exemplary intersection with multiple assemblies installed.

FIG. 3 is a top plan view of an exemplary intersection 36 with multiple assemblies 10 (e.g., 10A, B, C, D). More specifically, FIG. 3 illustrates a four-way intersection where two roads 34 intersect. Four assemblies 10 may be placed near the intersection 36 such that the flow of traffic is stopped in all four directions. However, any number of assemblies 10 may be utilized with any kind or type of intersection 36 with any number of roads 34. For example, without limitation, two assemblies 10 may be placed at a four way intersection, three assemblies 10 may be placed at a three way intersection, one assembly 10 may be placed at a three way intersection, and the like.

All of the assemblies 10 for a given intersection 36 may be in electronic communication with the command center 32 by way of a wired or wireless connection. In exemplary embodiments, the command center 32 may be buried near the respective intersection 36, though any location is contemplated. It is contemplated that assemblies 10 for more than one intersection 36 may be in communication with a common command center 32.

Figure 4:
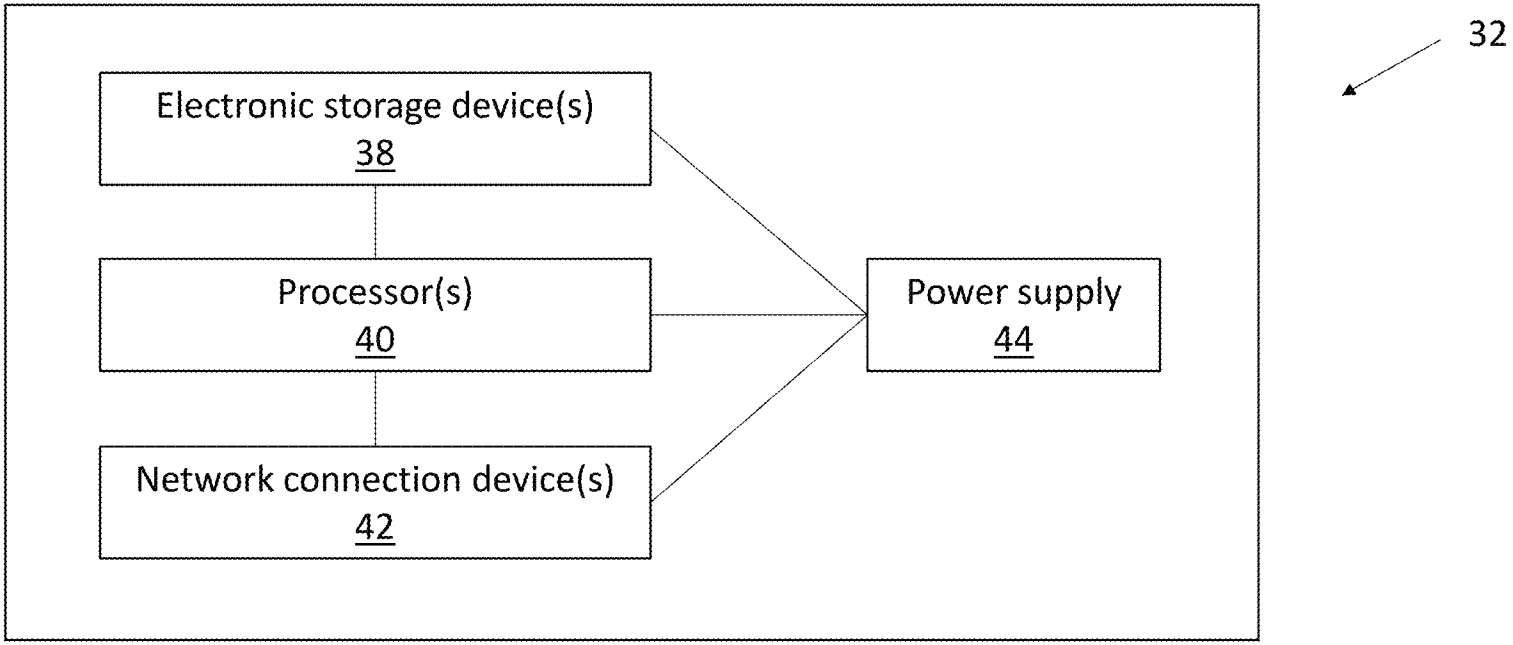
FIG. 4 is a simplified illustration of a command center.

FIG. 4 is a simplified illustration of the command center 32. The command center 32 may be in wired or wireless communication with the controller 20 of each assembly 10 for a particular intersection 36. The command center 32, and various components thereof, may be electrically connected to a power supply 44. The power supply 44 may comprise one or more batteries. Alternatively, or additionally, the power supply 44 may comprise a connector for connecting to a utility line. Alternatively, or in addition, the power supply 44 may comprise a solar panel, wind turbine, some combination thereof, or the like.

The command center 32 may comprise one or more electronic storage devices 38, processors 40, and network connection devices 42. The electronic storage device 38 may be configured to receive and store data from the various assemblies 10. The electronic storage device 38 may further comprise executable software instructions, which when executed configure the processor 40 to perform one or more of the processes disclosed herein. The processor 40 may be configured to retrieve the data and/or executable software instructions stored at the electronic storage device 38. The network connection device 42 may be configured to transmit and receive data, such as but not limited to data stored at the electronic storage device 38, to one or more of the controllers 20 for each assembly 10 and/or other remote device(s). Such communication may be accomplished by way of a network such as the internet, intranet, cellular network, world wide web, or the like. Such communication may be accomplished by wired or wireless means.

Figure 5:
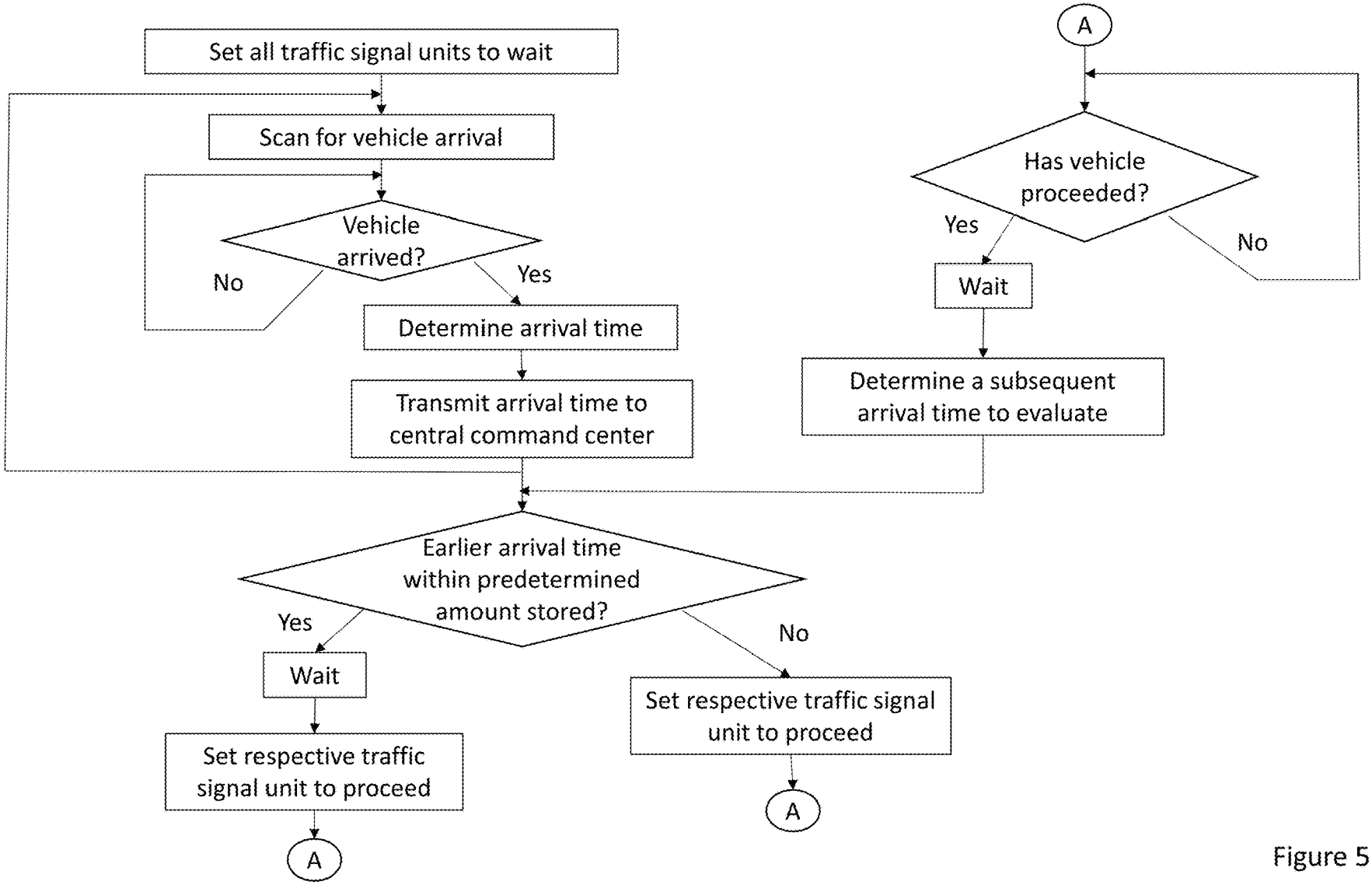
FIG. 5 is a flow chart with exemplary logic for operating the system of FIG. 3 in accordance with the present invention.

FIG. 5 is a flow chart with exemplary logic for operating a system of the assemblies 10 at an intersection 36, such as but not limited to, the intersection 36 shown and described with respect to FIG. 3. Initially, all of the traffic signaling devices 16 for all assemblies 10 for a particular intersection 36 may be set to wait. For example, without limitation, the traffic signaling device 16 may illuminate a red colored light. The vehicle detection devices 19 for all assemblies 10 for the particular intersection 36 may continuously scan for a vehicle's 70 arrival at the intersection 36. In exemplary embodiments, the vehicle detection devices 19 are configured to scan for vehicles 70 located at or near the stop line 35 associated with the respective assembly 10. For example, without limitation, the vehicle detection devices 19 may periodically, continuously, or at any interval take images of the intersection and use machine vision software to determine if a vehicle 70 is within the captured image. As another example, without limitation, the vehicle detection devices 19 may periodically, continuously, or at any interval transmit ultrasonic signals and determine if signals indicating the presence of a nearby vehicle 70 are received.

If no vehicle 70 is detected, the assemblies 10 may continue to scan. Once a vehicle 70 is detected, the respective assembly 10 may determine the vehicle's 70 arrival time at the time keeping device 28. The arrival time may be stored such as at the one or more electronic storage devices 22 of the controller 20. The arrival time may be transmitted to the command center 32. This communication, in exemplary embodiments, is made by way of the network connection device 26 in the respective assembly 10 and the network connection device 42 at the command center 32.

The command center 32 may determine if an earlier arrival time that is within a predetermined amount of time is stored at the electronic storage device 38 for the command center 32. The predetermined amount of time may be any amount of time. In exemplary embodiments, the predetermined amount of time is set such that a vehicle 70 may safely clear the intersection. The predetermined amount of time may be set from historical information.

If no earlier arrival time falling within the predetermined amount of time is found, the command center 32 may direct the respective assembly 10 to set the respective traffic signaling device 16 to proceed. For example, without limitation, the respective traffic signaling device 16 may illuminate a green colored light.

If an earlier arrival time falling within the predetermined amount of time is determined, the command center 32 may direct the respective assembly 10 to wait a sufficient amount of time such that the predetermined amount of time is reached and subsequently instruct the assembly 10 to set the respective traffic signaling device 16 to proceed. Alternatively, the command center 32 may wait until the predetermined amount of time is reached and subsequently direct the respective assembly 10 to set its respective traffic signaling device 16 to proceed.

The vehicle detection device 19 for the assembly 10 which was directed to set its traffic signaling device 16 to proceed may scan to ensure that the vehicle 70 signaled to proceed has actually proceeded. If the vehicle 70 has not proceeded, the vehicle detection device 19 may continue to scan until the vehicle 70 proceeds. In exemplary embodiments, the respective traffic signaling device 16 may take further action such as flashing a green light, emitting an audible tone, some combination thereof, or the like. Once the vehicle 70 has proceeded, a confirmation message regarding the same may be sent to the command center 32. The command center 32 may then evaluate the next earliest vehicle 70 arrival time, thereby repeating the process.

In other exemplary embodiments, once directing the respective traffic signaling device 16 to proceed, the command center 32 may wait a second predetermined amount of time before directing the next respective traffic signaling device 16 to proceed. The second predetermined amount of time may be the same or different as the predetermined amount of time. The second predetermined amount of time may be, for example without limitation, a certain multiple of the predetermined amount of time.

The command center 32 may then repeat the evaluation process for the next subsequently logged entry. In this way, the command center 32 evaluates and processes the arrival times in the order in which they occurred such that earlier arrival times are given priority.

It is notable that while the command center 32 is evaluating the arrival times, the assemblies 10 may be continuously scanning for vehicles 70, storing, and transmitting the arrival times to the command center 32. In this way, each vehicle's 70 arrival time may be logged and addressed in turn. If no additional vehicles 70 have arrived in the intervening time, the assemblies 10 may simply continue to scan for vehicles 70.

In exemplary embodiments, the vehicle detection device 19 may be capable of scanning the entire intersection 36 to determine when a vehicle 70 has cleared the intersection. In such embodiments, once the vehicle 70 has cleared the intersection, a confirmation message regarding the same may be sent to the command center 32. The command center 32 may then evaluate the next earliest vehicle 70 arrival time. Each vehicle detection device 19 may comprise multiple sensors of the same or different type which may scan the same or different areas.

In the unlikely event that two identical arrival times are determined, the command center 32 may randomly direct one of the two assemblies 10 to wait the predetermined amount of time and direct the other assembly 10 to set the respective traffic signaling device 16 to proceed.

Figure 6:
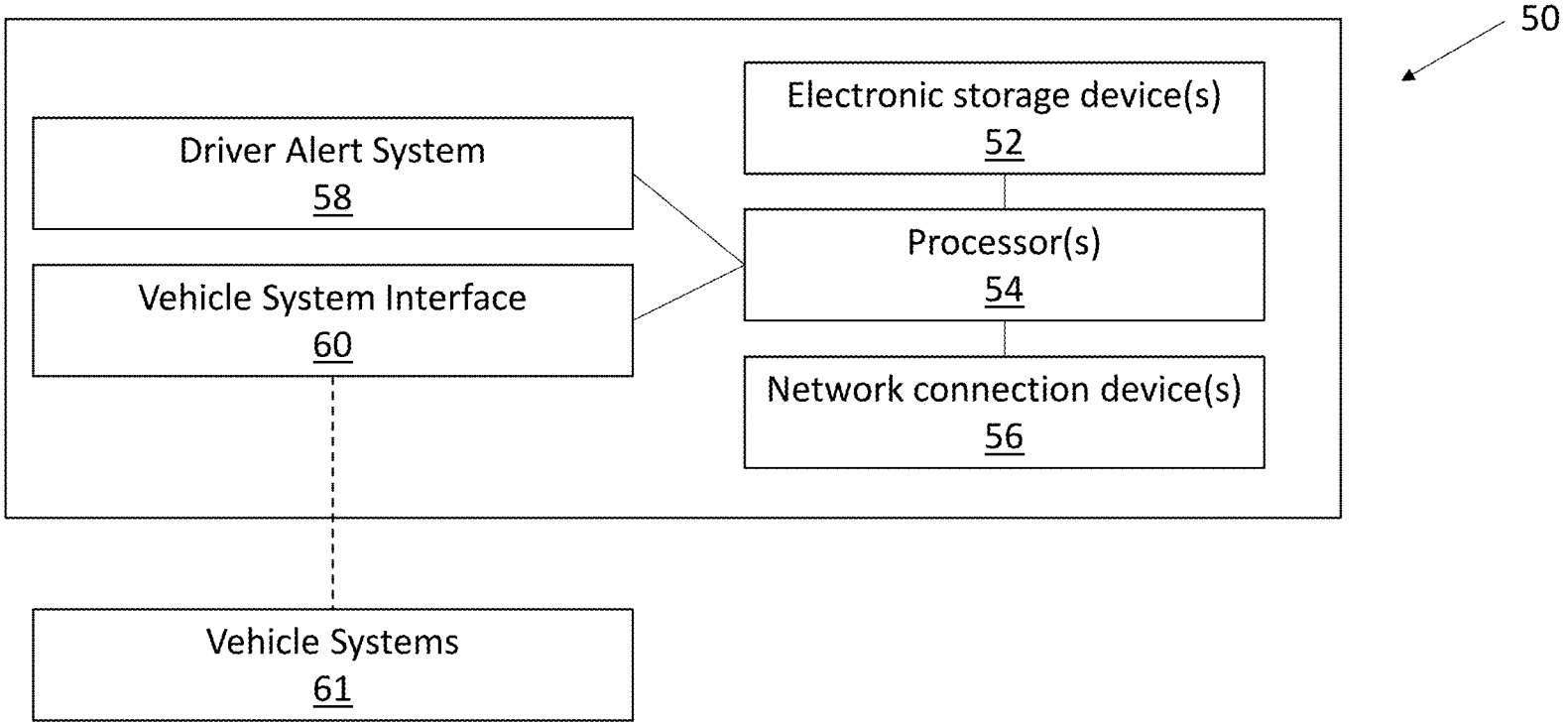
FIG. 6 is a simplified illustration of an exemplary vehicle-based system.

FIG. 6 is a simplified illustration of an exemplary vehicle-based system 50. The vehicle-based system 50 may be located at a vehicle 70. For example, without limitation, the vehicle-based system 50 may comprise a vehicle's 70 onboard computer system, may interface with the same, combinations thereof, or the like. The vehicle-based system 50 may comprise one or more processors 54. The vehicle-based system 50 may comprise one or more electronic storage devices 52. The one or more electronic storage devices 52 may comprise executable software instructions configured to provide some or all of the functionality shown and/or described herein when executed by one or more processors 54. The vehicle-based system 50 may comprise one or more network communication devices 56. The network communication devices 56 may comprise one or more wireless communication devices configured for near field and/or far reaching wireless communication, such as but not limited to, wi-fi, RFID, Bluetooth® protocol devices, cellular networks, internet communication, intranet communication, communication over the world wide web, combinations thereof, or the like. The processor(s) 54 may be in electronic communication with one or more driver alert systems 58 and/or vehicle system interface 60. In exemplary embodiments, the vehicle system interface 60 may be in electronic communication (wired or wireless) with, or mechanically connected to, one or more vehicle systems 61. Such vehicle systems 61 may include, for example without limitation, an acceleration system, a braking system, a transmission, and/or one or more sensors (e.g., accelerometer, speedometer, tachometer, proximity sensors, cameras, combinations thereof, or the like) for the vehicle 70. The driver alert systems 58 may comprise one or more devices configured to provide visual and/or audible alerts to the driver. A number of such vehicle-based systems 50 may be utilized, each of which may be located at a given one of a number of vehicles 70.

Figure 7A:
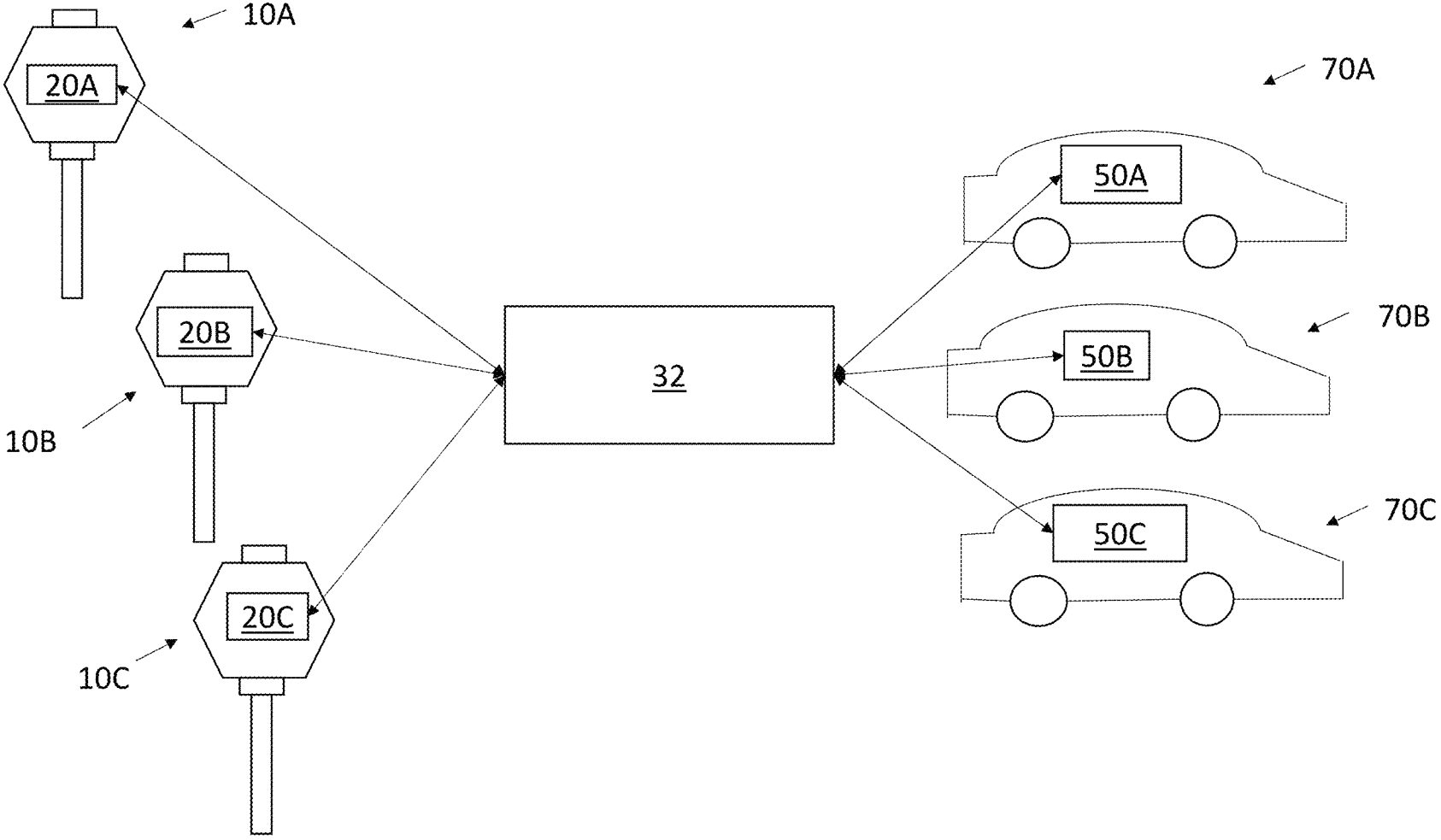
FIG. 7A is a simplified illustration of an exemplary system for providing signaling to multiple vehicles with the vehicle-based system of FIG. 6.

FIG. 7A is a simplified illustration of an exemplary system for providing signaling to vehicles 70A, B, C. Some or all vehicles 70A, B, C may comprise one of the vehicle-based systems 50A, B, C. Each vehicle-based system 50A, B, C may be configured to electronically receive the wait or proceed signals from the command center 32. Such wait or proceed signals may be also communicated from the command center 32 to the various controllers 20A, B, C of assemblies 10A, B, C. For example, without limitation, the command center 32 may determine which vehicle 70A, B, C should proceed first, such as but not limited to, in accordance with the disclosures shown and/or provided herein, and a command to provide a proceed signal may be sent to both an appropriate one of the vehicle-based system 50A, B, C and the associated assembly 10A, B, C. A command to provide a wait signal may be transmitted from the command center 32 to remaining ones of the vehicle-based system 50A, B, C and the associated assemblies 10A, B, C for an intersection. The commands transmitted may be sent at the same time and in the same format, or may be sent separately and/or in a different format.

Figure 7B:
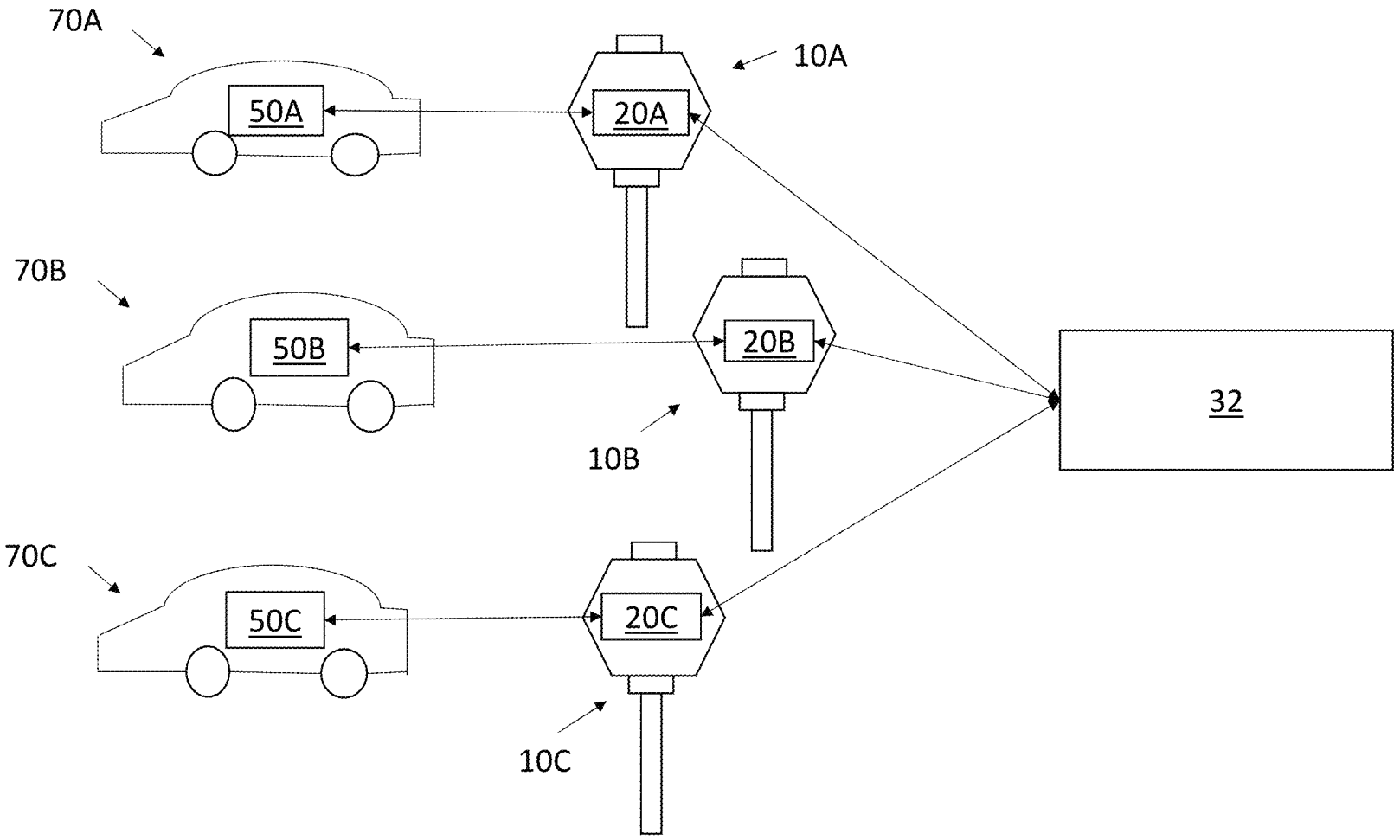
FIG. 7B is a simplified illustration of another exemplary system for providing signaling to multiple vehicles with the vehicle-based system of FIG. 6.

FIG. 7B is a simplified illustration of another exemplary system for providing signaling to vehicles 70A, B, C. In the illustrated embodiment, communication between the vehicle-based systems 50A, B, C may flow through the controllers 20A, B, C of the assemblies 10A, B, C. For example, without limitation, the commands to provide wait or proceed signals may be first sent from the command center 32 to the controllers 20A, B, C of the assemblies 10A, B, C. Following receipt, the assemblies 10A, B, C, may relay such the same or similar commands to the vehicle-based system 50A, B, C of the vehicles 70A, B, C.

In exemplary embodiments, upon arrival of a vehicle 70 having one of the vehicle-based systems 50, the adjacent assembly 10, may detect the arrival of the vehicle 70. Such detection may be made by way of the vehicle detection device 19 for the assembly 10. Identifying information, such as but not limited to a unique identifier for the vehicle 70, may be transmitted from the vehicle-based system 50 to the command center 32 and/or the assembly 10, such as by way of the network communication device 56 to the vehicle detection device 19 and/or the network connection device 26. The command center 32 and/or the assemblies 10, such as but not limited to by way of the network communication device 56 to the vehicle detection device 19 and/or the network connection device 26, may transmit commands to provide a wait or proceed signal to the vehicle-based systems 50. Alternatively, or additionally, the assemblies 10, such as by way of the vehicle detection devices 19 and/or network connection device 26, may broadcast appropriate commands to a respective signaling range to be picked up by any vehicle-based system 50 in sufficient proximity to the assembly 10. Alternatively, or additionally still, the command center 32 may broadcast appropriate commands within a signaling range, such as by way of the network communication devices 42 with the identifiers for the vehicles, to be picked up by any vehicle-based system 50 in sufficient proximity to the command center 32.

In exemplary embodiments, the assemblies 10, or the vehicle detection device 19 in particular, may comprise a combination of sensors or communications devices such that traffic signaling may be accomplished both for vehicles 70 equipped with the vehicle-based system 50 and those which are not. For example, without limitation, the vehicle detection device 19 may comprise both a near field communication device and a camera. Where the camera detects a vehicle 70 but no identifier is received at the near field communication device, the arrival time of the vehicle 70 may be documented and the traffic signal of the traffic signaling device 16 may be adjusted accordingly in accordance with the exemplary techniques shown and/or described herein. Where the camera detects a vehicle 70 and/or an identifier is received at the near field communication device, the arrival time of the vehicle 70 may be documented with the identifier and the traffic signal of the traffic signaling device 16 may be adjusted accordingly in accordance with the exemplary techniques shown and/or described herein.

Identifiers for multiple vehicles 70, each having one of the vehicle-based systems 50, may be received at one or more of the assemblies 10 and passed to the command center 32 for determining which assembly 10 and vehicle 70 to signal to proceed in accordance with any of the exemplary techniques shown and/or described herein. Any type of kind of identifier for any number of vehicles 70, each having a same or different one of the vehicle-based systems 50, at any number of assemblies 10 may be received and processed at the command center 32 for one, or any number of intersections.

In other exemplary embodiments, the identifier may not be required. Instead, for example without limitation, a signal indicating proceed or wait may be sent by the vehicle detection device 19 associated with the assembly 10 for which the wait or proceed signal has been received from the command center for receipt by any vehicle-based systems 50 within signaling range of the vehicle detection devices 19. The signaling range of the vehicle detection devices 19 may be configured to reach only those vehicles 70 stopped adjacent to the assembly 10.

Figure 8:
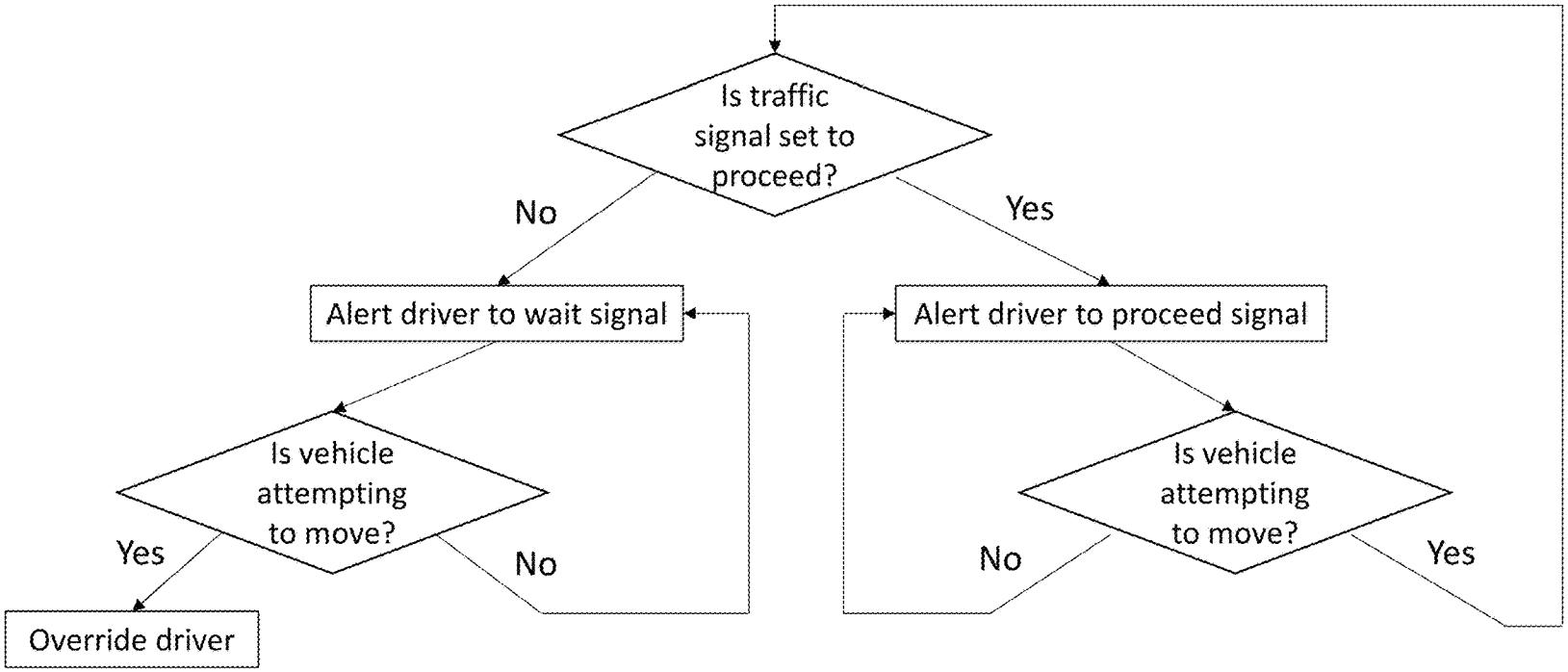
FIG. 8 is a flow chart with exemplary logic for operating the vehicle-based system of FIGS. 6-7B.

FIG. 8 is a flow chart with exemplary logic for operating the vehicle-based systems 50. If the vehicle-based system 50 receives a wait signal from the command center 32, the vehicle-based systems 50 may be configured to alert the driver to the wait signal.

If the vehicle-based system 50 has received a wait signal and the vehicle system interface 60 indicates that the driver is attempting to move the vehicle 70, the vehicle system interface 60 may override the driver's commands and stop the vehicle 70 from moving. For example, without limitation, the vehicle system interface 60 may detect attempted movement where the braking system indicates a decrease or release of applied brakes, applications of a clutch, an increase in applied acceleration, a shift into drive, combinations thereof, or the like. For example, without limitation, the vehicle system interface 60 may cease vehicle 70 movement by applying or increasing braking at the braking system, decrease or cease the application of acceleration at the acceleration system, shift the transmission (e.g., into neutral, a lower gear, or park), combinations thereof, or the like. Alternatively, or additionally, the same or additional alerts may be transmitted to the driver at the driver alert systems 58. Examples of such further alerts including flashing lights, increasing illumination, playing an audible recording, replaying the audible recording, replaying the audible recording at a higher volume, displaying a message, redisplaying the same message or displaying a new message, combinations thereof, or the like.

If the vehicle-based system 50 receives a proceed signal from the command center 32, the vehicle-based systems 50 may be configured to alert the driver to the proceed signal. If the driver does not attempt to move the vehicle 70, such as within a predetermined period of time following alert of the proceed signal, one or more further alerts may be provided. Examples of such further alerts including flashing lights, increasing illumination, playing an audible recording, replaying the audible recording, replaying the audible recording at a higher volume, displaying a message, redisplaying the same message or displaying a new message, combinations thereof, or the like. Detection of movement, or lack thereof, may be made by way of the vehicle system interface 60. Detection of attempted movement may be made, for example without limitation, by releasing of brakes, application of acceleration, applications of a clutch, shifting transmission (e.g., into drive, a low gear), combinations thereof, or the like.

Figure 9A:
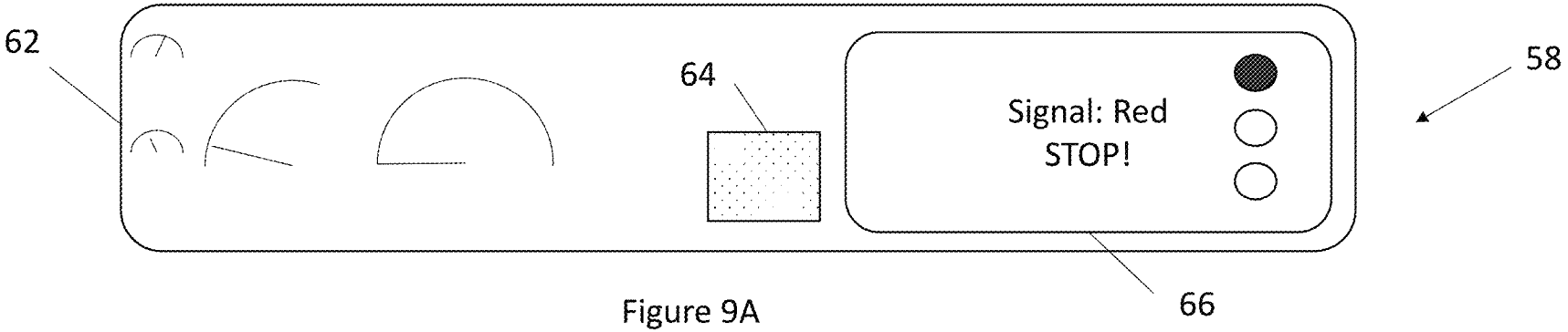
FIG. 9A is an exemplary dashboard with an exemplary display for the vehicle-based system of FIG. 6 with an exemplary wait signal.
Figure 9B:
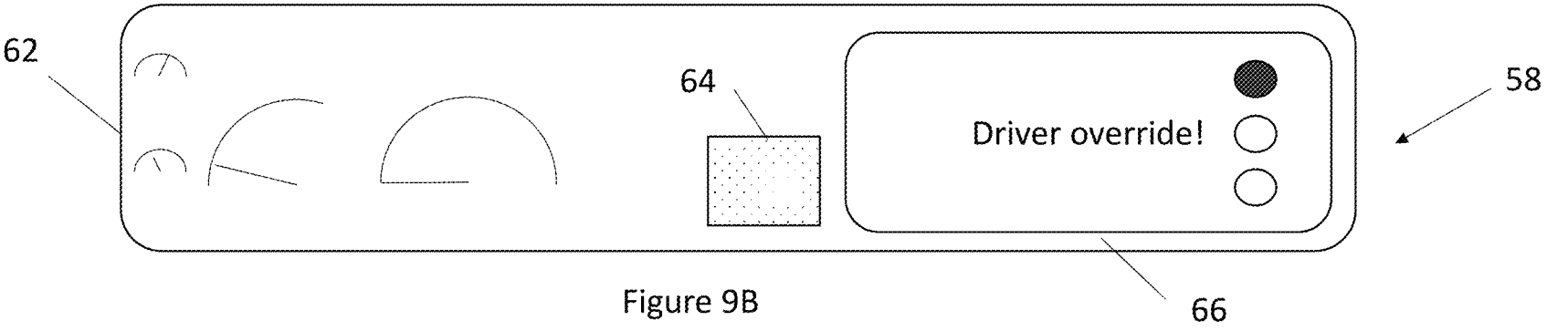
FIG. 9B is the exemplary dashboard of FIG. 9A with an exemplary override signal.
Figure 9C:
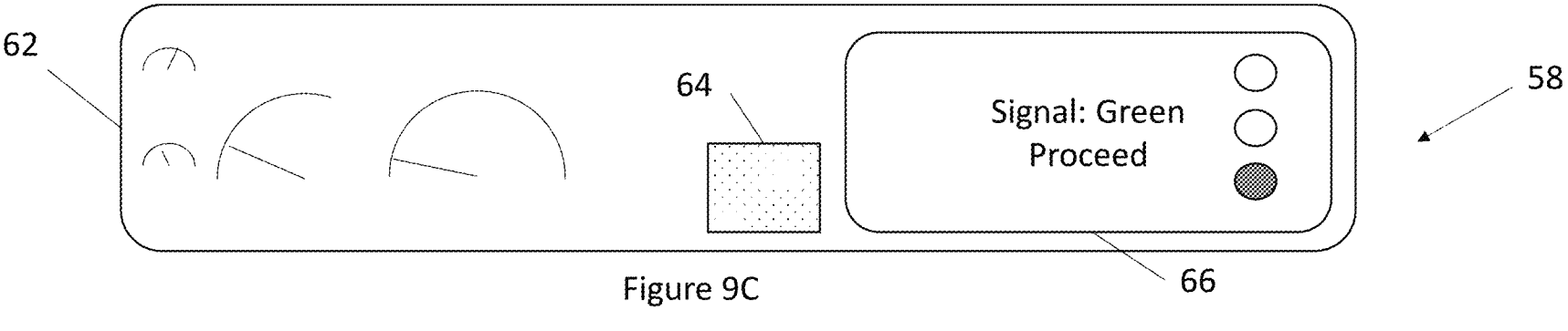
FIG. 9C is the exemplary dashboard of FIG. 9A with an exemplary proceed signal.

FIG. 9A through FIG. 9C illustrate an exemplary dashboard 62 for an exemplary vehicle 70 with an exemplary driver alert system 58 integrated with the dashboard 62. The driver alert system 58 may comprise one or more electronic displays 66 configured to visually display messages, speakers 64 configured to provide audible messages, lights, combinations thereof, or the like. While illustrated as located at the dashboard 62, the driver alert system 58, or components thereof, may alternatively or additionally be located elsewhere in the vehicle 70, such as standalone displays, integrated with other vehicle 70 speakers, combinations thereof, or the like. The driver alert systems 58 may be the same or different across different types of vehicles 70.

As illustrated for example, without limitation, at FIG. 9A, where the vehicle-based system 50 of a vehicle 70 receives a wait signal, a visual depiction of such a signal may be displayed at the electronic display(s) 66 of the driver alert system 58. The visual depiction of the wait signal may comprise a red light, a traffic light with the red light illuminated, a stop sign, the traffic signaling device 16, the one or more signaling devices 18A, 18B, text (e.g., "stop", "wait", "red light", combinations thereof, or the like), combinations thereof, or the like. Alternatively, or additionally, an audible alert such as a recording of the words, "stop", "wait", "red light", combinations thereof, or the like, may be played through the speaker(s) 64. As another example, without limitation, one or more not necessarily colorized lights may be illuminated.

As illustrated for example, without limitation, at FIG. 9B, where the vehicle-based system 50 of a vehicle 70 that has received a wait signal also receives an indication that the driver is attempting to move the exemplary vehicle 70, the driver alert system 58 may display a visual communication at the electronic display(s) 66 to the driver that the driver's commands are being overridden, such as but not limited to, by flashing a red light, displaying the words "driver override" or similar, and/or an audible alert such as a recording of the words "driver override" may be played through the speaker(s) 64. As another example, without limitation, one or more not necessarily colorized lights may be illuminated.

As illustrated for example, without limitation, at FIG. 9C, where the vehicle-based system 50 of a vehicle 70 receives a signal to proceed, a visual depiction of the proceed signal may be provided at the electronic display(s) 66 of the driver alert system 58. The visual depiction may comprise a green light, a traffic light with a green light illuminated, removal of a stop sign graphic, the traffic signaling device 16, the one or more signaling devices 18A, 18B, text (e.g., "proceed", "go", "green light", combinations thereof, or the like), combinations thereof, or the like. Alternatively, or additionally, an audible alert such as a recording of the words, "proceed", "go", "green light", combinations thereof, or the like, may be played through the speaker(s) 64. As another example, without limitation, one or more not necessarily colorized lights may be illuminated.

Figure 10:
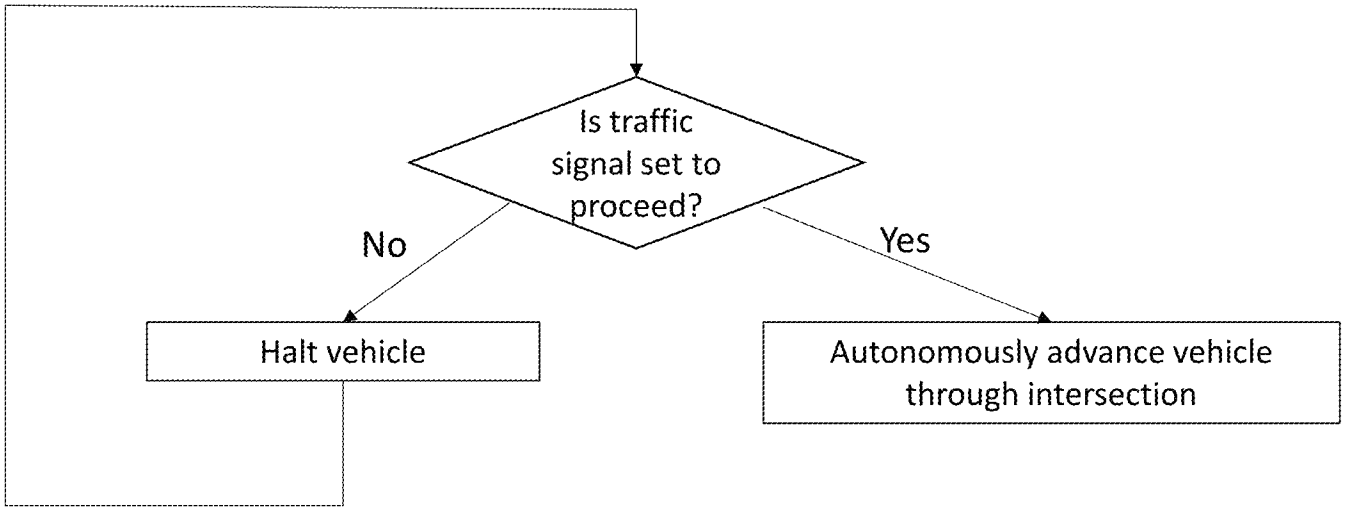
FIG. 10 is a flow chart with other exemplary logic for operating the vehicle-based system of FIGS. 6-7B.

FIG. 10 is a flow chart with exemplary logic for operating at least partially autonomous vehicles 70 with the assemblies 10 and/or command center 32. Where a proceed signal is received at the vehicle-based system 50 associated with a given one of the assemblies 10 to which a proceed signal is and/or has been transmitted, the vehicle system interface 60 may command certain vehicle systems 61 to, partially or fully, autonomously advance the vehicle 70 through the intersection. Such advancement may include, for example without limitation, release of the braking system, application of acceleration systems, shifting into drive or another gear, control of the steering, combinations thereof, or the like. Where a wait signal is received at the vehicle-based system 50 associated with a given one of the assemblies 10 to which a wait signal has been transmitted, the vehicle system interface 60 may command certain vehicle systems 61 to halt movement of the vehicle 70. Such halting may include, for example without limitation, application of the braking system, deactivation of the accelerator systems, shifting into park, neutral, or other gear, combinations thereof, or the like. Such autonomous vehicle control may be accomplished using one or more proximity sensors, cameras, known or yet to be developed autonomous vehicle control systems.

In exemplary embodiments, without limitation, such vehicle 70 operation may be performed without regard to transmission of signals to/from the assemblies 10. For example, without limitation, such signals for halting and/or advancing vehicles 70 may be sent directly from the command center 32 to the vehicle-based systems 50.

Figure 11:
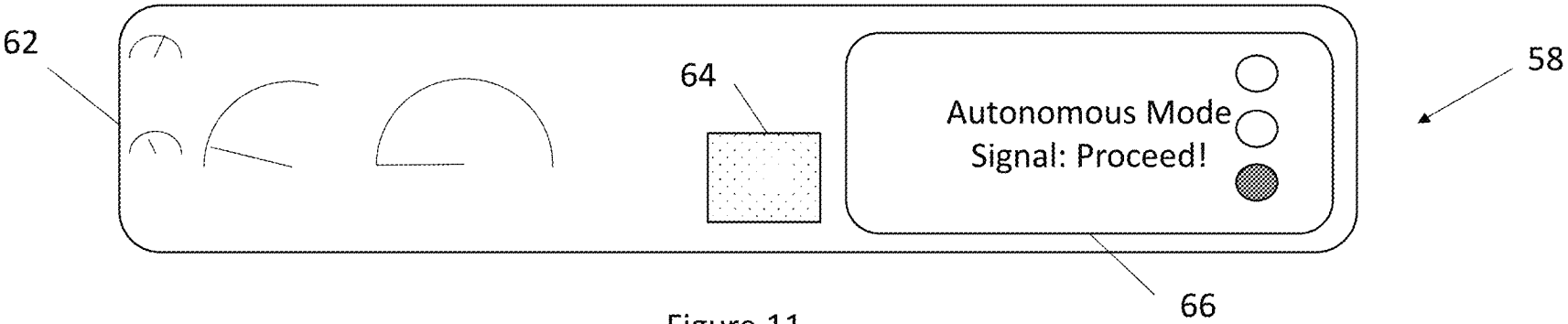
FIG. 11 is the exemplary dashboard of FIG. 9A with an exemplary autonomous mode signal.

As illustrated in FIG. 11, the one or more driver alert systems 58 may be configured to display and/or provide an audible message, such as at the one or more electronic display 66 and/or speakers 64 respectively, a message that the vehicle 70 is operating in an autonomous control mode.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing devices. The electronic devices may be personal computers, smartphones, tablets, databases, servers, or the like. The electronic connections and transmissions described herein may be accomplished by wired or wireless means.

What is claimed is:

1. A system for providing traffic signals to drivers of vehicles, said system comprising:

vehicle-based systems, each associated with a respective identifier, located at a respective one of the vehicles, and configured to selectively provide a wait message and a proceed message to a respective one of the drivers of the respective one of the vehicles;

stop signs, each associated with an intersection and comprising:

a vehicle detection device having a respective signaling range and configured to detect any of the vehicles within the respective signaling range and receive any of the identifiers from any of the vehicles within the respective signaling range and comprising one of the vehicle-based systems;

a traffic signaling device configured to signal the respective one of the drivers of the respective one of the vehicles at a respective one of the stop signs to proceed or wait;

a time keeping device configured to record arrival times of the vehicles detected by the vehicle detection device; and a command center configured to:

electronically receive the recorded arrival times from the stop signs;

electronically receive the identifiers associated with the arrival times;

determine which of the received arrival time is earliest;

command a given one of the stop signs associated with the earliest of the received arrival times to signal proceed at the traffic signaling device; and if the earliest of the received arrival times is associated with one of the identifiers, command the vehicle-based system of the vehicle associated with the earliest of the received arrival times to provide the proceed message.

2. The system of claim 1 wherein:

said command center is configured to:

command each of the stop signs not associated with the earliest arrival time to provide the signal wait at the traffic signaling devices associated with each of the stop signs not associated with the earliest arrival time; and command the vehicle-based systems of any of the vehicles not associated with the earliest of the received arrival times and having one of the vehicle-based systems to provide the wait message.

3. The system of claim 1 wherein:

each of said vehicle-based systems comprise an electronic display configured to selectively visually display the wait message and the proceed message.

4. The system of claim 3 wherein:

said proceed message comprises a visual depiction of an illuminated green light upon; and said wait message comprises a visual depiction of an illuminated red light.

5. The system of claim 1 wherein:

each of vehicle-based systems comprise a speaker configured to audibly provide the proceed message and the wait message.

6. The system of claim 5 wherein:

said proceed message comprises a recording directing the driver to proceed; and said wait message comprises a recording directing the driver to proceed.

7. The system of claim 2 further comprising:

a number of vehicle override devices, each associated with one of the vehicle-based systems and in electronic communication with one or more vehicle systems of the respective one of the vehicles, wherein each of said vehicle override devices are configured to, upon determining that the respective one of the vehicles is attempting to move after the command to provide the wait message at the respective one of the number of vehicle-based systems is received and before a command to provide the proceed message at the respective one of the number of vehicle-based systems is received, directing a braking system for the respective one of the vehicles to apply brakes of the respective one of the vehicles.

8. The system of claim 1 wherein:

each of said vehicle-based systems is in electronic communication with one or more vehicle systems of the respective one of the vehicles and is configured to, upon receipt of the command to provide the proceed message at the respective one of the number of vehicle-based systems, direct the one or more vehicle systems of the vehicle to autonomously advance the vehicle through the intersection.

9. The system of claim 1 wherein:

each of vehicle detection devices at each of said stop signs comprise a near field communication device;

each of said vehicle-based systems comprise a network communication device configured to communicate with each of said near field communication devices; and the command to provide the proceed message at the vehicle-based system of the vehicle associated with the earliest of the received arrival times is provided to the vehicle-based systems by way of the near field communication devices.

10. The system of claim 9 wherein:

each of said vehicle detection devices comprise a camera configured to detect any of the vehicles located within a capture area of the camera.

11. The system of claim 9 wherein:

the command to provide the proceed message to the vehicle-based system of the vehicle associated with the earliest of the received arrival times comprises the identifier associated with the earliest of the received arrival times; and the vehicle-based system receiving the command to proceed is configured to check if the received identifier matches the identifier associated with the vehicle-based system before providing the proceed message.

12. The system of claim 1 wherein:

the command center comprises a network communication device; and the command to provide the proceed message at the vehicle-based system of the vehicle associated with the earliest of the received arrival times is provided to directly to the network communication device located at the respective one of the vehicle-based systems by way of the network communication device located at the command center.

13. The system of claim 1 wherein:

said vehicle detection device is configured to transmit wireless electronic communication signals within the respective signaling range and detect any of the vehicles within the respective signaling range by return of said wireless electronic communications signals from any of the vehicles within the respective signaling range, said return signals comprising the identifiers.

14. A method for providing traffic signals to drivers of vehicles, said method comprising:

electronically receiving arrival times upon arrival of vehicles at stop signs associated with an intersection;

electronically receive identifiers for at least some of said arriving vehicles, wherein each of said electronically received identifiers is associated with one of the electronically received arrival times;

determine an earliest one of said electronically received arrival times; and command a traffic signaling device associated with one of the stop signs associated with the earliest one of the electronically received arrival times and a vehicle-based system associated with one of the vehicles associated with the identifier associated with the earliest one of the electronically received arrival times to provide a proceed signal;

wherein said arrival of said vehicles is detected by vehicle detection devices, each located at one of said stop signs, and said identifiers are received at said vehicle detection devices at said stop signs.

15. The method of claim 14 further comprising the step of:

commanding the traffic signaling devices associated with all other of the stop signs other than the one of the stop signs and all of the vehicle-based systems associated with all other of the vehicles other than the one of the vehicles to provide a wait signal.

16. The method of claim 14 further comprising the step of:

determining, by way of a vehicle override device in electronic communication with a braking system, that a given one of the vehicles other than the one of the vehicles is attempting to move; and commanding the braking system of the given one of the vehicles, by way of the vehicle override system, to apply brakes of the given one of the vehicles to stop the vehicle from moving.

17. The method of claim 14 wherein:

said arrival times are recorded by time keeping devices, each located at one of said stop signs;

each of said arrival times and identifiers are received at a command center in electronic communication with each of said stop signs;

said determination of said earliest one of said electronically received arrival times is made at said command center; and said command to provide said proceed signal at said traffic signaling device associated with one of the stop signs and said vehicle-based systems associated with one of the vehicles is transmitted from said command center.

18. The method of claim 14, wherein:

each of said vehicle detection devices comprise near field communication devices; and each of said vehicle detection devices comprise cameras or proximity sensors.

19. The method of claim 14 wherein:

at least some of said vehicle-based systems comprise an electronic display configured to display a visual depiction of said proceed signal.

20. A system for providing traffic signals to drivers of vehicles, said system comprising:

a number of vehicle-based systems, each located at one of a subset of the vehicles and comprising a driver alert system configured to visually or audibly provide wait and proceed messages to a respective one of the drivers of a respective one of the number of vehicles;

a number of stop signs, each associated with an intersection and comprising:

a vehicle detection device configured to detect any of the number vehicles within a signaling range of the vehicle detection device by receipt of wireless electronic communication signal from such vehicles in the subset with the signaling range of the vehicle detection device, the received wireless electronic communication signals comprising identifiers;

a traffic signaling device configured to signal the drivers of the vehicles at the stop sign to proceed or wait;

a time keeping device;

a network communication device; and a controller in electronic communication with the vehicle detection device, the traffic signaling device, the time keeping device, and the network communication device, wherein said controller is configured to:

receive an indication from the vehicle detection device that a given one of the number of vehicles has arrived at the stop sign;

record an arrival time for the given vehicle;

record any identifier received for the given vehicle in association with the received arrival time; and electronically transmit the recorded arrival time and any recorded identifier to a command center;

a controller located at the command center in electronic communication with the controllers of each of the number of stop signs by way of a network communication device at the command center and the network communication devices at each of the stop signs, and controller configured to:

electronically receive the recorded arrival times;

electronically receive any recorded identifiers associated with said received recorded arrival times;

order the recorded arrival times chronologically;

transmit a command to a given one of the stop signs associated with the earliest of the recorded arrival times to set the traffic signaling device associated with the given one of the stop signs to proceed; and if the earliest of the recorded arrival times is associated with a given one of the recorded identifiers, transmit a command to the driver alert system associated with a given one of the number of vehicles in the subset associated with the given one of the recorded identifiers to signal proceed at the driver alert system associated with the given one of the number of vehicles.

21. The system of claim 20 wherein:

each of said number of vehicle-based systems is in communication with one or more vehicle systems of the respective one of the vehicles and is configured to, upon receipt of the command to provide the proceed message at the respective one of the number of vehicle-based systems, direct one or more vehicle systems of the vehicle to autonomously advance the vehicle through the intersection.

* * * * *